United States Patent [19]

Yoneyama et al.

[11] Patent Number: 5,063,147

[45] Date of Patent: Nov. 5, 1991

[54] SILVER HALIDE PHOTOGRAPHIC LIGHT-SENSITIVE MATERIAL CONTAINING ALIPHATIC CARBOXYLIC ESTER

[75] Inventors: Masakazu Yoneyama; Ryosuke Yamada; Yosuke Nishiura; Yukio Maekawa, all of Kanagawa; Yuzo Higaki, Tokyo; Yoshiaki Iwamoto, Kanagawa, all of Japan

[73] Assignee: Fuji Photo Film Co., Ltd., Kanagawa, Japan

[21] Appl. No.: 515,992

[22] Filed: Apr. 27, 1990

[30] Foreign Application Priority Data

Apr. 28, 1989 [JP] Japan ..... 1-110388
Apr. 28, 1989 [JP] Japan ..... 1-110389

[51] Int. Cl.[5] ..... G03C 1/76

[52] U.S. Cl. ..... 430/523; 430/529; 430/531; 430/539; 430/633; 430/635; 430/638; 430/961

[58] Field of Search ..... 430/523, 529, 531, 539, 430/633, 635, 638, 961

[56] References Cited

U.S. PATENT DOCUMENTS 2,843,487 7/1958 Knox et al. ..... 430/638
3,121,060 2/1964 Duane ..... 430/523
4,820,615 4/1989 Vandenabeele et al. ..... 430/961
4,873,182 10/1989 Delprato et al. ..... 430/638

FOREIGN PATENT DOCUMENTS 0090633 5/1983 Japan ..... 430/638
61-090152 5/1986 Japan ..... 430/539
1-062635 3/1989 Japan ..... 430/961

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

Disclosed is a silver halide photographic light-sensitive material comprising a support and a light-sensitive silver halide emulsion layer provided on the support, wherein a surface layer provided on the photographic light-sensitive material contains an aliphatic carboxylic ester having the formula (I) or the formula (II):

$$R^{11}COOR^{12} \quad (I)$$

in which each of $R^{11}$ and $R^{12}$ independently is an aliphatic hydrocarbon group having 12–70 carbon atoms; at least one of $R^{11}$ and $R^{12}$ is branched; and the number of the total carbon atoms contained in $R^{11}$ and $R^{12}$ is in the range of 32 to 140, $$R^{21}OOCXCOOR^{22} \quad (II)$$

in which each of $R^{21}$ and $R^{22}$ independently is an aliphatic hydrocarbon group having 12–70 carbon atoms; X is a divalent linking group; at least one of $R^{21}$, $R^{22}$ and X is a branched aliphatic hydrocarbon group having 12 or more carbon atoms; and the number of the total carbon atoms contained in $R^{21}$ and $R^{22}$ is in the range of 32 to 140.

18 Claims, No Drawings

SILVER HALIDE PHOTOGRAPHIC LIGHT-SENSITIVE MATERIAL CONTAINING ALIPHATIC CARBOXYLIC ESTER

FIELD OF THE INVENTION

The present invention relates to a silver halide photographic light-sensitive material which is improved in physical properties of its surface layer. More particularly, the invention relates to a silver halide photographic light-sensitive material (also referred to as "photographic light-sensitive material" or "photographic material" hereinafter) which is improved in slip properties (i.e., slipperiness) and resistance to damage (i.e., abrasion resistance).

BACKGROUND OF THE INVENTION

A photographic light-sensitive material generally comprises a support made of various materials (e.g., cellulose triacetate, polyethylene terephthalate, an ordinary paper, and a paper coated with polyethylene terephthalate on both surfaces) and a silver halide emulsion layer provided on one side of the support directly or both sides of the sup port via an undercoating (or subbing) layer. If desired, the photographic material may be optionally provided with additional layers such as an intermediate layer a protective layer, a filter layer, an antistatic layer and an anti-halation layer. These additional layers generally contains a hydrophilic binder (e.g., gelatin) as their main component. An X-ray film, that is one example of photographic light-sensitive materials has photographic emulsion layer on both sides of the support, but most of the photographic light-sensitive materials are provided with a photographic emulsion layer on one side of the support. In the latter case, the photographic light-sensitive material has a free surface on the support where a photographic emulsion layer is not provided, and this free surface is generally called "a back surface" of the photographic light-sensitive material in this art. On the back surface of the photographic light-sensitive material is generally provided an auxiliary layer such as an anti-halation layer, an antistatic layer, an anti-curling layer or an overcoat layer to enhance photographic or physical qualities.

The photographic light-sensitive material having the above constitute is generally brought into contact with various apparatus in its process for the preparation including coating procedure, drying procedure, etc. or brought into contact with other various devices, machines or cameras in handling (for example, transferring procedure and winding or rewinding procedure in various stages such as picture-taking, developing, printing and projecting stages). When the photographic material is in contact with those apparatus or machines, seriously adverse effects are apt to be given to the photographic material. In addition, the same adverse effects are also given to the photographic material when dusts or waste fibers are attached to the material. For example, scratches or abrasions are brought about on the photographic emulsion layer side or the back surface side of the photographic material, or the photoraphic material does not run smoothly in a camera or other machines. Moreover, waste films (waste photographic materials) are produced. Particularly, scratches easily occur on the back surface of the photographic material, because this surface is frequently brought into contact with various devices. These scratches appear on a visible image during the printing stage or the projecting stage, resulting in serious problem in the practical use. Recently, the photographic light-sensitive material is treated under more severe conditions than the conventional ones, because the use thereof or the process for the preparation thereof is extended (for example, high-speed coating, rapid photographing or rapid processing is developed) or the photographic material is used in various circumstances such as in an atmosphere of high temperature and high humidity. Under such severe conditions, the photographic material is more easily scratched, or smooth running of the material in various machines is hardly obtained Accordingly, the photographic light sensitive material is desired to have high qualities of its surface even under such severe conditions.

For improving the slip properties and the resistance to damage on the surface of the photographic light-sensitive material, a lubricant (i.e., slip property-increasing agent) is conventionally contained in the surface layer of the photographic material. Examples of the lubricants generally employed for that purpose include polyorganosiloxane as described in Japanese Patent Publication No. 53(1978) 292, higher aliphatic acid amides as described in U.S. Pat. No. 4,275,146, higher aliphatic acid esters as described in U.K. Patent No. 927,446 and Japanese Patent Provisional Publications No. 55(1980).126238 and No. 58(1983) 90633, aliphatic acid diesters as described in Japanese Patent Publication No. 58(1983) 33541 and U.K. Patent No. 1,320,564, and higher aliphatic acid metal salts as described in U.S. Pat. No. 3,933,516.

Under the severe conditions as in the recent high-speed transferring stage, however, satisfactory effect can be hardly obtained by the above mentioned conventional method, although the slip properties and the resistance to damage of the photographic material can be improved to a certain level. Further, other problems still resides in the conventional method. For example, when silicone is employed as a lubricant of a backing layer (i.e., a layer provided on the back surface) the added silicone moves to the surface of the support where a photographic emulsion is to be coated to give an adverse effect in the emulsion-coating procedure, that is, cissing or watting takes place to markedly deteriorate the coating properties of the sur face. The surface layer containing above the lubricant shows relatively high slip properties and high resistance to damage immediately after the formation of the surface layer, but the layer deteriorates in those properties with time (that is, the lubricant diffuses within the surface layer), or white powders are produced on the back surface because of bleeding of the lubricant. Further, the lubricant is melted out or diffuses off from the surface layer during the development stage, whereby favorable effect cannot be given even by adding the lubricant Furthermore, thus diffused lubricant sometimes pollutes the treating liquid.

For provision of a backing layer using the lubricant there can be generally used a process comprising the steps of dissolving or dispersing the lubricant singly or with a binder in an appropriate solvent to prepare a coating solution (or dispersion), and coating the solution or the dispersion over a support. If the lubricant has a nature of swelling the support, the lubricant easily diffuses within the support and hardly remains on the surface of the sup port. As a result, satisfactory slip properties cannot be obtained. For enhancing the slip properties, the lubricant is generally used in a larger amount in the conventional method, but in this case, the lubricant is easily deposited on the surface of the photographic material owing to the increased concentration of the coating solution, and thereby the stages for the preparation of the photographic material polluted.

SUMMARY OF THE INVENTION

An object of the invention is to provide a photographic light-sensitive material whose surface layer shows satisfactory slip properties and high resistance to damage and is almost free from physical deterioration with time even under high-speed transferring conditions or after the development process Another object of the invention is to provide a photoraphic light sensitive material which is improved in slip properties and resistance to damage without lowering of the coating properties in its preparation stages.

There is provided by the present invention a silver halide photographic light sensitive material which comprises a support and at least one light-sensitive silver halide emulsion layer provided on one side of the support, wherein at least one layer of surface layers provided on the photographic light-sensitive material contains an aliphatic carboxylic ester (an aliphatic hydrocarbon group containing ester compound) having the formula (I):

$$R^{11}COOR^{12} \quad (I)$$

in which each of $R^{11}$ and $R^{12}$ independently is an aliphatic hydrocarbon group having 12–70 carbon atoms; at least one of $R^{11}$ and $R^{12}$ is a branched aliphatic hydrocarbon group having 12 or more carbon atoms; and the number of the total carbon atoms of $R^{11}$ and $R^{12}$ is in the range of 32 to 140.

There is also provided by the invention a silver halide photographic light sensitive material which comprises a support and at least one light-sensitive silver halide emulsion layer provided on one side of the support, wherein at least one layer of surface layers provided on the photographic light-sensitive material contains an aliphatic carboxylic ester (an aliphatic hydrocarbon group-containing ester compound) having the formula (II):

$$R^{21}OOCXCOOR^{22} \quad (II)$$

in which each of $R^{21}$ and $R^{22}$ independently is an aliphatic hydrocarbon group having 12–70 carbon atoms; X is a divalent linking group; any one of $R^{21}$, $R^{22}$ and X is a branched aliphatic hydrocarbon group having 12 or more carbon atoms; and the number of the total carbon atoms of $R^{21}$ and $R^{22}$ is in the range of 32 to 140.

The photographic light-sensitive material of the invention which contains an ester compound containing a branched aliphatic hydrocarbon group (i.e., a branched aliphatic hydrocarbon group-containing ester compound) shows higher slip properties and higher resistance to damage as compared with conventional photographic light-sensitive materials containing known ester compounds. Further, the photographic light-sensitive material of the invention is almost free from lowering of the slip properties and resistance to damage with time or after photographic processing.

Therefore, the photographic material of the invention having such high qualities can be advantageously used as various photographic materials for rapid processing which need to be hardly damaged on the surface of the emulsion layer even under severe photographic conditions such as conditions of high pH value, high speed and high humidity in automatic photographic machines, or as cinematographic positive materials (cinematographic films) which need to have such a high mechanical strength on the film surface as resist to repeated projections.

Straight-chain aliphatic hydrocarbon groups having 20 or more carbon atoms or esters thereof having total carbon atoms of 40 or more generally have markedly low solubility, so that it is very difficult to prepare a coating solution using them. Further, since such ester compounds have a high melting point, bleeding of the ester compounds easily takes place to cause occurrence of white powders on the coated layer, resulting in various troubles in the use of the obtained photographic material. However, the branched aliphatic hydrocarbon group-containing ester compound employable in the invention (i.e., compound having the formula (I) or the formula (II)) shows high solubility in an organic solvent in spite that the aliphatic hydrocarbon group thereof has a large number of carbon atoms. Accordingly, a coating solution containing the ester compound which is used in the preparation of a photographic light-sensitive material of the invention does not become turbid, and can be favorably coated without any trouble in the coating stage. The photographic light-sensitive material prepared using this coating solution is almost free from the above-mentioned bleeding, so that troubles caused by the white powders can be avoided. The above-described coating solution containing the ester compound is particularly effective for forming a backing layer. The reasons are assumably as follows. That is, the ester compound used in the invention has higher molecular weight as compared with the compounds described in the above-mentioned various publications, and the aliphatic hydrocarbon group of the ester compound is branched, so that there can be obtained high solubility in the coating solution and high activity on the surface of the coated layer.

Also in the case of incorporating the ester compound into the backing layer, any adverse effect cannot be given to the coating properties of the emulsion layer. Further, the ester compound incorporated into the backing layer does not give any photographic disadvantage such as occurrence of fogging or sensitization to the resulting photographic light-sensitive material.

DETAILED DESCRIPTION OF THE INVENTION

As the ester compound employable for the photographic light-sensitive material of the invention, there are two kinds of aliphatic hydrocarbon group containing ester compounds. These two kinds of the aliphatic hydrocarbon group-containing ester compounds are now described in detail.

One of the aliphatic hydrocarbon group containing ester compounds employable for the photographic light-sensitive material of the invention has the formula (I):

$$R^{11}COOR^{12} \quad (I)$$

In the formula (I), each of $R^{11}$ and $R^{12}$ independently is an aliphatic hydrocarbon group having 12–70 carbon atoms. Further, any one of $R^{11}$ and $R^{12}$ is a branched aliphatic hydrocarbon group having 12 or more (preferably 24 or more) carbon atoms, and the total carbon atoms of $R^{11}$ and $R^{12}$ is in the range of 32 to 140, preferably 41 to 140, more preferably 48 to 140. The aliphatic hydrocarbon group may have an unsaturated bond.

In the invention, each of $R^{11}$ and $R^{12}$ in the formula (I) preferably is a branched aliphatic hydrocarbon group having 12 or more (preferably 24 or more) carbon atoms. Further, a branch of the branched aliphatic hydrocarbon group is preferably located at the second position from the carbon atom bonding to the ester group (—COO—) in each of $R^{11}$ and $R^{12}$.

Examples of alcohols and monocarboxylic acids, which are materials of the branched aliphatic hydrocarbon group constituting the branched aliphatic hydrocarbon group-containing ester compound having the formula (I), are described below.

Branched aliphatic alcohols:

$C_6H_{13}CH(C_8H_{17})CH_2OH$ ($C_{16}$) (A-1)

$CH_3(CH_2)_7CH((CH_2)_5CH_3)CH_2OH$ ($C_{16}$) (A-2)

$C_7H_{15}CH(C_9H_{19})CH_2OH$ ($C_{18}$) (A-3)

$CH_3(CH_2)_8CH((CH_2)_6CH_3)CH_2OH$ ($C_{18}$) (A-4)

$CH_3(CH_2)_mCH(CH_3)(CH_2)_nOH$ ($C_{18}$) (A-5)
m + n = 15

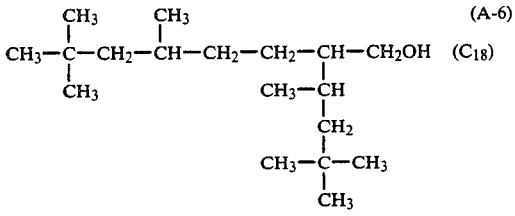
(A-6)

$CH_3(CH_2)_9CH((CH_2)_7CH_3)CH_2OH$ ($C_{20}$) (A-7)

$CH_3(CH_2)_{11}CH((CH_2)_9CH_3)CH_2OH$ ($C_{24}$) (A-8)

$C_{10}H_{21}CH(C_{13}H_{27})CH_2OH$ ($C_{25}$) (A-9)

$C_{12}H_{25}CH(C_{11}H_{23})CH_2OH$ ($C_{25}$) (A-10)

$C_{13}H_{27}CH(C_{11}H_{23})CH_2OH$ ($C_{26}$) (A-11)

$C_mH_{2m+1}CH(C_nH_{2n+1})CH_2OH$ ($C_{32}$–$C_{36}$) (A-12)
m + n = 30–34
(e.g., 2-cetylstearyl alcohol, etc.)

Branched aliphatic carboxylic acids:

-continued $CH_3(CH_2)_7CH((CH_2)_5CH_3)COOH$ ($C_{16}$) (I-C-1)

$CH_3(CH_2)_mCH(CH_3)(CH_2)_nCOOH$ ($C_{18}$) (I-C-2)
m + n = 14

$CH_3(CH_2)_8CH((CH_2)_6CH_3)COOH$ ($C_{18}$) (I-C-3)

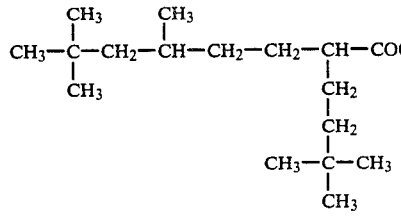
(I-C-4)

$CH_3(CH_2)_9CH((CH_2)_7CH_3)COOH$ ($C_{20}$) (I-C-5)

$CH_3(CH_2)_{11}CH((CH_2)_9CH_3)COOH$ ($C_{24}$) (I-C-6)

$C_mH_{2m+1}CH(C_nH_{2n+1})COOH$ ($C_{32}$–$C_{36}$) (I-C-7)
m + n = 30–34

Concreted examples of the branched aliphatic hydrocarbon group-containing ester compounds having the formula (I) which can be preferably employed for the photographic light-sensitive material of the invention are as follows.

(n)$C_{21}H_{43}COOC_{18}H_{37}$(iso) (I-1)
(n)$C_{21}H_{43}COOC_{24}H_{49}$(iso) (I-2)
(iso)$C_{17}H_{35}COOC_{32}H_{65}$—$C_{36}H_{73}$(iso) (I-3)
(n)$C_{27}H_{55}COOC_{18}H_{37}$(iso) (I-4)
(n)$C_{17}H_{35}COOC_{32}H_{65}$—$C_{36}H_{73}$(iso) (I-5)
(n)$C_{21}H_{43}COOC_{16}H_{33}$(iso) (I-6)
(n)$C_{21}H_{43}COOC_{20}H_{41}$(iso) (I-7)
(iso)$C_{17}H_{35}COOC_{50}H_{101}$(n) (I-8)
(iso)$C_{23}H_{47}COOC_{24}H_{49}$(iso) (I-9)
(iso)$C_{31}H_{63}$—$C_{35}H_{71}COOC_{18}H_{37}$(iso) (I-10)
(n)$C_{27}H_{55}COOC_{24}H_{49}$(iso) (I-11)

The other of the aliphatic hydrocarbon group-containing ester compounds employable for the photographic light-sensitive material of the invention has the formula (II):

$$R^{21}OOCXCOOR^{22} \quad \text{(II)}$$

In the formula (II) each of $R^{21}$ and $R^{22}$ independently is an aliphatic hydrocarbon group having 12–70 carbon atoms and X is a divalent linking group. Further, any one $R^{21}$, $R^{22}$ and X is a branched aliphatic hydrocarbon group having 12 or more (preferably 24 or more) carbon atoms, and the total carbon atoms of $R^{21}$ and $R^{22}$ is in the range of 32 to 140 (preferably 40 to 140). In the invention, each of $R^{21}$ and $R^{22}$ preferably is a branched aliphatic hydrocarbon group having 12 or more (preferably 24 or more) carbon atoms. The aliphatic hydrocarbon group may have an unsaturated bond. Further, a branch of the branched aliphatic hydrocarbon group is preferably located at the second position from the carbon atom bonding to the ester group (—COO—) in each of $R^{21}$ and $R^{22}$.

Examples of alcohols and dicarboxylic acids, which are materials of the branched aliphatic hydrocarbon group constituting the branched aliphatic hydrocarbon group contain ester compound having the formula (II), are described Examples of the branched aliphatic alcohols employable as the materials of the branched aliphatic hydrocarbon group are those described before with respect to the aliphatic hydrocarbon group containing ester compound having the formula (I). Examples of dicarboxylic acids employable as the mate rials of the branched aliphatic hydrocarbon group are as follows. Branched aliphatic dicarboxylic acids:

$$HOOC(CH_2)_6\underset{\underset{C_2H_5}{|}}{CH}(CH_2)_9COOH \quad (C_{20}) \qquad \text{(II-C-1)}$$

$$HOOC(CH_2)_6\underset{\underset{CH_3}{|}}{CH}(CH_2)_4\underset{\underset{CH_3}{|}}{CH}(CH_2)_6COOH \quad (C_{22}) \qquad \text{(II-C-2)}$$

Examples of the divalent linking groups indicated by X in the formula (II) are described below.

$$\leftarrow CH_2 \rightarrow_n \quad (n = 2\text{-}20) \qquad \leftarrow CH_2)_6\underset{\underset{C_2H_5}{|}}{CH}(CH_2 \rightarrow_9$$

$$\leftarrow CH_2)_6\underset{\underset{CH_3}{|}}{CH}(CH_2)_4\underset{\underset{CH_3}{|}}{CH}(CH_2 \rightarrow_6$$

$$-CH_2CH_2OCH_2CH_2- \qquad$$

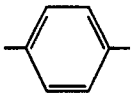

drogenated dimer acid residual group such as;

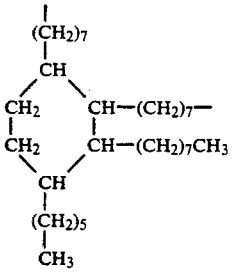

Concrete examples of the branched aliphatic hydrocarbon group-containing ester compounds having the formula (II) which can be preferably employed for the photographic light-sensitive material of the invention as follows.

$$\begin{array}{l} COOC_{24}H_{49}(iso) \\ | \\ (CH_2)_2 \\ | \\ COOC_{24}H_{49}(iso) \end{array} \qquad \text{(II-1)}$$

$$\begin{array}{l} COOC_{24}H_{49}-C_{26}H_{53}(iso) \\ | \\ (CH_2)_4 \\ | \\ COOC_{24}H_{49}-C_{26}H_{53}(iso) \end{array} \qquad \text{(II-2)}$$

-continued $$\begin{array}{l} COOC_{32}H_{65}-C_{36}H_{73}(iso) \\ | \\ (CH_2)_4 \\ | \\ COOC_{32}H_{65}-C_{36}H_{73}(iso) \end{array} \qquad \text{(II-3)}$$

$$\begin{array}{l} COOC_{24}H_{49}-C_{26}H_{53}(iso) \\ | \\ (CH_2)_8 \\ | \\ COOC_{24}H_{49}-C_{26}H_{53}(iso) \end{array} \qquad \text{(II-4)}$$

$$\begin{array}{l} COOC_{32}H_{65}-C_{36}H_{73}(iso) \\ | \\ (CH_2)_8 \\ | \\ COOC_{32}H_{65}-C_{36}H_{73}(iso) \end{array} \qquad \text{(II-5)}$$

$$\begin{array}{l} COOC_{24}H_{49}-C_{26}H_{53}(iso) \\ | \\ (CH_2)_{10} \\ | \\ COOC_{24}H_{49}-C_{26}H_{53}(iso) \end{array} \qquad \text{(II-6)}$$

$$\begin{array}{l} COOC_{16}H_{33}(iso) \\ | \\ (CH_2)_{12} \\ | \\ COOC_{21}H_{43}(n) \end{array} \qquad \text{(II-7)}$$

$$\begin{array}{l} COOC_{24}H_{49}-C_{26}H_{53}(iso) \\ | \\ (CH_2)_{20} \\ | \\ COOC_{24}H_{49}-C_{26}H_{53}(iso) \end{array} \qquad \text{(II-8)}$$

$$\begin{array}{l} COOC_{24}H_{49}-C_{26}H_{53}(iso) \\ | \\ (CH_2)_9 \\ | \\ CH-C_2H_5 \\ | \\ (CH_2)_6 \\ | \\ COOC_{24}H_{49}-C_{26}H_{53}(iso) \end{array} \qquad \text{(II-9)}$$

$$\begin{array}{l} COOC_{32}H_{65}-C_{36}H_{73}(iso) \\ | \\ (CH_2)_9 \\ | \\ CH-C_2H_5 \\ | \\ (CH_2)_6 \\ | \\ COOC_{32}H_{65}-C_{36}H_{73}(iso) \end{array} \qquad \text{(II-10)}$$

$$\begin{array}{l} COOC_{18}H_{37} \\ | \\ (CH_2)_6 \\ | \\ CH-CH_3 \\ | \\ (CH_2)_4 \\ | \\ CCH_3 \\ | \\ (CH_2)_6 \\ | \\ COOC_{18}H_{37}(n) \end{array} \qquad \text{(II-11)}$$

$$\begin{array}{l} COOC_{24}H_{49}-C_{26}H_{53}(iso) \\ | \\ (CH_2)_6 \\ | \\ CH-CH_3 \\ | \\ (CH_2)_4 \\ | \\ CH-CH_3 \\ | \\ (CH_2)_6 \\ | \\ COOC_{24}H_{49}-C_{26}H_{53}(iso) \end{array} \qquad \text{(II-12)}$$

-continued (II-13)

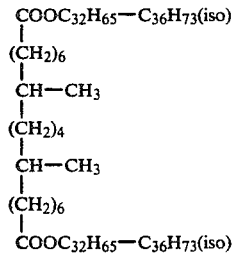

(II-14)

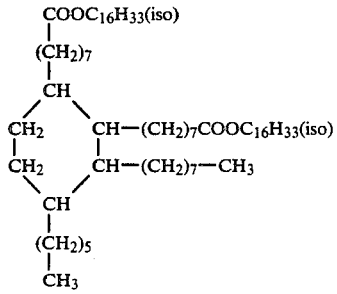

(II-15)

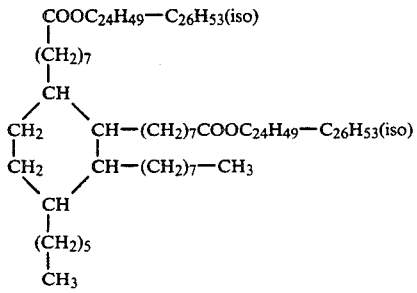

(II-16)

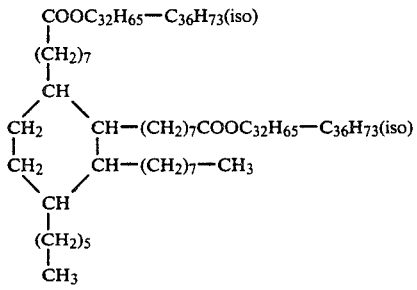

The branched aliphatic hydrocarbon group-containing ester compounds having the formula (I) or the formula (II) which are employable in the invention, can be readily prepared by known processes. That is, they can be prepared through dehydration reaction of an acid with alcohol or dehydrochlorination reaction of an acid chloride with alcohol. Further, as the branched aliphatic acids or the branched aliphatic alcohols (i.e., materials of the ester compounds), various synthetic acids or alcohols can be utilized.

The photographic light-sensitive material of the invention contains the branched aliphatic hydrocarbon group-containing ester compound having the formula (I) or the formula (II) in its surface layer(s). The terms "surface layer" used herein means a layer arranged on the most outer side of the photographic material. In the photographic material having a silver halide emulsion layer on only one side of the support, the surface layer means a layer arranged on the silver halide emulsion layer or a layer arranged on the opposite side to the emulsion layer side (i.e., back surface side of the material). In the photo graphic material having a protective layer provided on the silver halide emulsion layer and a backing layer (having one or more functions) on the back surface, both of those layers (protective layer and backing layer) are surface layers, that is, each of those layers may contain the branched aliphatic hydrocarbon group-containing ester compound having the formula (I) or the formula (II).

The ester compound having the formula (I) or the formula (II) can be incorporated into the surface layer(s) by the following process. The terms "ester compound" used hereinafter may be either an ester compound having the formula (I) or an ester compound having the formula (II), unless specifically mentioned. The ester compound is beforehand dissolved in water, an organic solvent or a mixture thereof, and the obtained solution is then added to a hydrophilic colloid liquid for the formation of a surface layer to be arranged on the emulsion layer side or is added to various solutions for the formation of a backing layer (i.e., a layer to be arranged on the back surface), to prepare a coating solution. Otherwise, the ester compound is added to the above-mentioned hydrophilic colloid liquid or various solutions in the form of an aqueous dispersion having been prepared in the presence of an appropriate dispersing agent such as a surface active agent, to prepare a coating dispersion. Thus prepared coating solution or dispersion is then coated over the photographic emulsion layer or the support. Alternatively, after various photographic layers are provided on the support, the most outer layer is coated or permeated with the coating solution or dispersion. Details of the hydrophilic colloids (e.g., gelatin) will be described later.

In the invention, it is most effective and preferred to incorporate the ester compound into the backing layer.

For the provision of a layer containing the ester compound on the photographic material through coating or permeation, there can be employed various processes such as a dipping process as described in U.S. Pat. No. 3,335,026, an extrusion process as described in U.S. Pat. No. 2,761,791, and a spraying process as described in U.S. Pat. No. 2,674,167. In those processes, the coating solution or dispersion containing the ester compound is coated or allowed to permeate from the outside of the photographic material.

There is no specific limitation on the amount of the ester compound employable in the invention. However, when the ester compound is added to the coating solution which is to be coated on the support, the amount thereof is generally in the range of 0.02 to 300% by weight, preferably in the range of 0.1 to 150% by weight, based on the solid weight of the composition of the coating solution. If the amount of the ester compound is less than 0.02% by weight, satisfactory effects can be hardly obtained.

For incorporation of the ester compound into the backing layer, a binder having film-forming properties is used with the ester compound Examples of the binders having such properties include cellulose esters such as cellulose triacetate, cellulose diacetate, cellulose acetate maleate, cellulose acetate phthalate, hydroxyalkyl alkylcellulose, and cellulose long-chain alkylesters; polycondensation polymers such as polycondensation products of formaldehyde and cresol, salicylic acid or oxyphenylacetic acid, and polycondensation products of terephthalic acid (or isophthalic acid) and polyalkylene glycol; homopolymers such as acrylic acid, methacrylic acid, styrene carboxylic acid and styrene sulfonic acid; copolymers of those monomers (or maleic anhydride) with styrene derivatives, alkylacrylate, alkylmethacrylate, vinyl chloride, vinyl acetate, alkyl vinyl ether or acrylonitrile; ring-opened half esters or half amides of those copolymers and partially-hydrolyzed polyvinyl acetate; and synthetic polymers such as homopolyers or copolymers obtained from monomers having polymerizable unsaturated bonds (e.g., vinyl alcohols).

Also in the case of using a binder, water, an organic solvent or a mixture thereof can be employed as a solvent for the ester compound. As examples of the aforementioned solvents or the solvents employable together with the binder, there can be used alcohols such as methanol, ethanol and butanol; ketones such as acetone and methyl ethyl ketone; halogenated hydrocarbons such as carbon tetrachloride and chloroform; ethers such as diethyl ether, dioxane and tetrahydrofuran; and aromatic hydrocarbons such as benzene, toluene and xylene.

When the ester compound is used together with above-mentioned binder to prepare a coating solution for the formation of a backing layer, the amount of the ester compound is generally in the range of approx. 1 to 300% by weight, preferably 2 to 150% by weight, based on the amount of the binder.

In the formation of the surface layer of the photo graphic material according to the invention, the ester compound is preferably used in combination with a matting agent. Examples of the matting agents include inorganic compounds such as silica and barium strontium sulfate, and organic polymers such as polymethyl methacrylate and polystyrene, in the form of fine particles having a mean particle diameter of 0.01–10 μm.

The silver halide photographic light-sensitive material of the present invention whose surface layer(s) contain the above mentioned branched aliphatic hydrocarbon group containing ester compound (i e., compound having the formula (I) or the formula (II)) is described below.

The silver halide photographic light sensitive mate rial of the invention has a basic structure comprising a support and a silver halide emulsion layer provided on the support. As described before, the photographic material of the invention includes various embodiments in which various auxiliary layers are further added to the above-mentioned basic structure.

The structure of the photographic material is described in detail hereinafter.

The silver halide emulsion layer is a layer composed of a silver halide and a binder (or a protective colloid).

Examples of the silver halide employable for the photographic material preferably are silver bromide, silver iodobromide, silver chloroiodobromide, silver chloroiodide and silver chloride, in the form of grains.

The silver halide grains employable in the invention may be of various crystal forms, for example, regular crystal form such as hexahedron or octahedron, irregular crystal form such as spherical form or tubular form, and mixed form thereof. A silver halide having grains of various crystal forms can be employed, but preferred is a silver halide having grains of regular crystal form.

The halogen composition of individual grains may be heterogeneous or homogeneous, that is, the halogen composition may vary between the surface portion and the inside portion or may be the same as each other. Further, the silver halide grains may be those in which a latent image is formed on the surface (e.g , those for negative-type emulsion) or those in which a latent image is formed inside thereof (e.g , those for internal latent image-type emulsion or direct reversal-type emulsion) Preferred are silver halide grains in which a latent image is formed mainly on the surface.

The silver halide emulsion employable in the invention preferably is a tubular grain emulsion in which tubular silver halide grains having a thickness of not more than 0.5 μm (preferably not more than 0.3 μm), a diameter of not more than 0.6 pm and a mean aspect ratio of not less than 5 are contained in an amount of 50% or more based on the projected area. Further, the silver halide emulsion employable in the invention preferably is an emulsion having such an almost uniform grain size distribution that a statistic variation efficiency is not more than 20%. The statistic variation efficiency (S/d) is determined by dividing a standard deviation (S) by a diameter (d) in the diameter distribution when the projected area is approximated to a circle. As the silver halide emulsion, a mixture of the tubular grain emulsion and the emulsion having ann almost uniform grain size distribution in combination of two or more kinds can be also employed.

The photographic emulsion employable in the invention can be prepared by processes as described in P. Glafkides, "Chimie er Physique Phographeque" (published by Paul Monter Co., 1967), G. F. Duffin, "Photographic Emulsion Chemistry" (published by Focal Press, 1966), and V. L. Zelikman, et al, "Making and Coating Photographic Emulsion" (published by Focal Press, 1964).

For controlling the grain growth during the formation of the silver halide grains, there can be employed solvents for the silver halide, such as ammonia, potassium thiocyanate, ammonium thiocyanate and thioether compounds as described in U.S. Pat. Nos. 3,271,157, 3,574,628, 3,704,130, 4,297,439 and 4,276,374; thion compounds as described in Japanese Patent Provisional Publications No. 53(1978) 144319, No. 53(1978) 82408 and No. 55(1980)-77737; and amine compounds as described in Japanese Patent Provisional Publication No. 54(1979) 100717.

In the stage for the formation of the silver halide rains or physical ripening thereof, there can be employed cadmium salt, zinc salt, thallium salt, iridium salt (or its complex salt), rhodium salt (or its complex salt), iron salt (or its complex salt), etc. The silver halide photographic emulsion employable in the invention may be color-sensitized by sensitizing dyes. Examples of the sensitizing dyes include methine dyes, cyanine dyes, merocyanine dyes, complex cyanine dyes, complex merocyanine dyes, holopolar cyanine dyes, hemicyanine dyes, styryl dyes, and hemioxonol dyes. Particularly preferred are cyanine dyes, merocyanine dyes and complex merocyanine dyes. For those dyes, any rings generally employable for cyan dyes as basic heterocyclic group are available. Examples of the rings employable for those dyes include pyrroline ring, oxazoline ring, thiazoline ring, pyrrole ring, oxazole ring, thiazole ring, serenazole ring, imidazole ring, tetrazole ring and pyridine ring. Further, also employable are rings obtained by bonding alicyclic hydrocarbon rings or aromatic hydrocarbon rings to the above-exemplified rings, for example, indolenine ring, benzindolenine ring, indole ring, benzoxazole ring, naphthooxazole ring, benzthiazole ring, naphthothiazole ring, benzserenazole ring, benzimidazole ring and quinoline ring. The above-exemplified rings may have a substituent group on the carbon atom.

The merocyanine dyes or the complex merocyanine dyes can use 5 or 6-membered heterocyclic rings (e.g., pyrazoline-5-one ring, thiohydantoin ring, 2-thiooxazolidine-2,4-ring, thizolidine-2,4-dione ring, rhodanine ring and thiobarbituric acid ring) as rings having ketomethylene structure.

The sensitizing dyes can be employed singly or in combination. Combinations of the sensitizing dyes are often used for the purpose of supersensitization. In addition to the sensitizing dyes, a substance which does not per se exhibit spectral sensitization effect or does not substantially absorb visible light but shows supersensitizing activity can be contained in the photographic emulsion. Examples of such substances include aminostylbenzene compounds substituted by nitrogen containing heterocyclic group as described in U.S. Pat. Nos. 2,933,390 and 3,635,721; condensates of aromatic organic acid and formaldehyde as described in U.S. Pat. No. 3,743,510; cadmium salts; and azaindene compounds. Combinations described in U.S. Pat. Nos. 3,615,613, 3,615,641, 3,617,295 and 3,635,721 are particularly effective.

The silver halide emulsion may contain anti-fogging agents for preventing occurrence of fogging during the preparation stage of the photographic material, the storing stage thereof and the photographic processing stage thereof, or stabilizers for stabilizing the photographic properties. Examples of the anti-fogging agents and stabilizers include azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (e.g., l-phenyl-5-mercaptotetrazole); mercaptopytrimidines; mercaptotriazines; thioketone compounds such as oxazolinethione; azaindenes such as triazaindenes, tetraazaindenes (e.g., 4-hydroxy-substituted (1,3,3*a*,7)tetraazaindenes and pentaazaindenes; benzenethiosulfonic acid; benzenesulfinic acid; and benzenesulfonic acid amide.

As a binder or a protective colloid employable for the emulsion layer, auxiliary layer or the hydrophilic colloid layer of the photographic material of the invention, gelatin is advantageously employed, but other protective colloids can be also employed. For example, there can be used proteins such as gelatin derivatives, graft polymers of gelatin and other polymers, albumin and casein; saccharide derivatives such as cellulose derivatives (e.g., hydroxyethyl cellulose, carboxymethyl cellulose and cellulose sulfate), alginic acid soda and starch derivatives; and synthetic hydrophilic homo. or co polymers such as polyvinyl acetal, polyvinyl alcohol partial acetal. poly-N-vinyl pyrrolidone, polyacrylic acid, polymethacrylic acid, polyacrylamide, polyvinyl imidazole and polyvinyl pyrazole.

Examples of gelatin employable for the emulsion layer, auxiliary layers, etc. includes general-purpose lime treated gelatin, acid-treated gelatin, oxygen-treated gelatin described in "Bull. Soc. Phot. Japan" No. 16, pp. 30 (1980), and hydrolyzate of gelatin.

The hydrophilic colloid layer may contain an inorganic or organic film-hardening agent. Examples of the film hardening agents (i.e., hardeners) include chromium salts, aldehydes (e.g., formaldehyde, glyoxal and glutaraldehyde), and N-methylol compounds (e.g., dimethylol urea). Active halogen compounds and active vinyl compounds are preferred because they show high-speed hardening to give stable photographic properties to the resulting photographic material. Concrete examples of the active halogen compounds include 2,4 dichloro-6-hydroxy-1,3,5-triazine and sodium salts thereof. Concrete examples of the active vinyl compounds include 1,3-bisvinylsulfonyl-2-propanol, 1,2-bis(vinylsulfonylacetamide)ethane, bis(vinylsulfonylmethyl) ether, and vinyl polymers having vinylsulfonyl group on the side chain. Also preferred are N carbamoylpyrizinium salts such as (l-morpholinocarbonyl-3-pyrizinio)methanesulfonate, and haloamizinium salts such as 1-(l-chloro-l-pyrizinomethylene)pyrrolizinium-2-naphthalenesulfonate, from the viewpoint of high-speed hardening.

The photographic emulsion layer or the hydrophilic protective layer may contain one or more surface active agents to improve various properties such as coating properties, antistatic properties, slip properties, emulsifying or dispersing properties, anti-tacking properties and photographic properties (e.g , development acceleration, high contrast and sensitization).

The hydrophilic colloid layer of the photographic material may contain water-soluble dyes. The water-soluble dyes contained in the hydrophilic colloid layer have various functions such as a function of anti-irradiation or a function of anti-halation as well as a function as a filter dye. Examples of the dyes preferably used for those purposes are oxonol dyes, hemioxonol dyes, styryl dyes merocyanine dyes, anthraquinone dyes and azo dyes. Also preferred are cyanine dyes, azomethine dyes, triallymethane dyes and phthalocyanine dyes. Further, oil-soluble dyes can be also added to the hydrophilic colloid layer by emulsifying in water the oil-soluble dyes through oily-droplet dispersing method.

The photographic light sensitive material of the invention can be used as a multi-layer, multicolor photographic material (i.e., multi-layer color photographic material) provided with two or more light-sensitive layers having different spectral sensitivities on the support. The multi-layer color photographic material generally has at least one red-sensitive emulsion layer, at least one green-sensitive emulsion layer and at least one blue sensitive emulsion layer, on the support. The arrangement of those layers can be optionally determined depending on the necessity. Preferably, the red-sensitive layer, the green sensitive layer and the blue sensitive layer are arranged from the support side in this order. Otherwise, the arrangement of the blue-sensitive layer, the green-sensitive layer and the red-sensitive layer in this order from the support side, or the arrangement of the blue sensitive layer, the red-sensitive layer and the green-sensitive layer in this order from the support side is also preferred. Further, two or more emulsion layers which are sensitive to the same color but shows different sensitivities can be provided to enhance the sensitivity. Provision of three emulsion layers can improve the graininess. A non sensitive layer may be interposed between two or more emulsion layers having the same color sensitivity. Otherwise, between two or more emulsion layers having the same color sensitivity may be interposed other emulsion layer having the different color sensitivity. A light-reflecting layer such as a layer of silver halide grains can be provided under a high-speed sensitive layer, particularly a high speed blue-sensitive layer, to enhance the sensitivity.

In general, the red sensitive emulsion layer contains cyan color-forming coupler, the green-sensitive emulsion layer contains magenta color-forming coupler, and the red-sensitive emulsion layer contains yellow color-forming coupler. However, other combination is also possible, for example, a layer sensitive to infrared rays can be combined to prepare a false color film or a film for exposure to semiconductor laser beam.

There is no specific limitation on the support where the above-mentioned silver halide emulsion layer is to be provided. As the support materials, there can be employed flexible materials which are generally used for known photographic materials, such as plastic films, papers and cloths; and rigid materials such as glass, ceramics and metals. Preferred examples of the flexible support materials include semi-synthetic or synthetic polymers such as cellulose nitrate, cellulose acetate, cellulose butyl acetate, polystyrene, polyvinyl chloride, polyethylene terephthalate and polycarbonate; baryta papers; and other papers coated or laminated with α-olefin polymers (e.g., polyethylene, polypropylene or ethylene-butene copolymer). The support may be colored with dyes or pigments. Further, the support may be made black for the purpose of light-blocking. The surface of the support is generally subjected to undercoating treatment for enhancing the adhesion with the photographic emulsion layer. The surface of the support may be further subjected to other various treatments such as glow discharge, corona discharge, irradiation with ultraviolet rays and flame treatment before or after the undercoating treatment.

The silver halide photographic light-sensitive material of the invention can be prepared by the process comprising the steps of preparing a coating solution or dispersion (i.e., light-sensitive liquid) containing the silver halide emulsion, binder and other optional components, then coating the solution or the dispersion over the support and drying the coated layer. Other optional hydrophilic colloid layers having desired functions can be also provided in the similar manner.

Coating of the photographic emulsion layer and the hydrophilic colloid layers can be made by known coating method such as dip coating, roller coating, flood coating and extrusion coating. If desired, two or more layers can be simultaneously coated by the coating methods as described in U.S. Pat. Nos. 2,681,294, 2,761,791, 3,526,528 and 3,508,947.

The photographic light-sensitive material of the invention can be used as a monochromatic or color photoraphic material. Concretely, it can be used as color negative films for domestic use or cinematographic use; and other films or papers for slide projection use or television use, such as color reversal films, color papers, color positive films and color reversal papers. Further, the photographic material of the invention can be also used as monochromatic light-sensitive materials for X-rays by utilizing a mixture of three-color couplers described in "Research Disclosure" No. 17,123, (July, 1978), or utilizing black color-forming coupler described in U.S. Pat. No. 4,126,461 and U.K. Patent No. 2,102,136. Moreover, the photographic material of the invention can be also used as films for plate making (e.g., lithographic films and scanner films), X-ray films for medical use or industrial use, monochromatic negative films for picture-taking, monochromatic photographic papers, microfilms for COM use or domestic use, and other light-sensitive printing materials.

Use of the photographic light-sensitive material of the present invention is described below.

The photographic light-sensitive material of the invention is subjected to exposure process, development process and fixing process in its use. Those processes are described in detail hereinafter.

Various exposure means can be employed in the exposure process. As the light source, any optional light source releasing a radiation corresponding to the sensitivity wavelength of the photographic material can be employed. Examples of the light sources generally used include natural light (sun light), incandescent lamp, halogen lamp, mercury lamp, fluorescent lamp, flash light sources (e.g , electric flash and metal-burning flashbulb). Light sources which emit light in the ultraviolet to infrared region can be also used as the recording light sources. For example, there can be mentioned gasses, dye solutions, semiconductor lasers, light emission diode, and plasma light source. Also employable are fluorescent surface given by the stimulated phosphor with electron rays (e.g., CRT) and an exposure means in which a microshutter array using liquid crystal (LCD), lanthanum-doped lead zirconate titanate (PLZT), etc. is combined with a linear or plane-like light source. If necessary, spectral distribution used in the exposure process can be appropriately adjusted by color filters.

A developing solution used in the monochromatic photoraphic processing can contain a developing agent. Examples of the developing agents include dihydroxybenzenes (e.g., hydroquineone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds such as a compound obtained by condensation of 1,2,3,4-tetrahydroquinoline ring and indolene ring described in U.S. Pat. No. 4,067,872. Those developing agents can be employed singly or in combination. Particularly, dihydroxybenzenes are preferably employed in combination with pyrazolidones and/or aminophenols. The developing solution may contain other various additives such as preservatives, alkali agents, pH buffering agent, antifogging agents, dissolving-assisting agents, color toning agents, development accelerators, surface active agents, defoaming agents, softening agents, hardeners, and viscosity-increasing agents. The temperature for the development process generally ranges from 18 to 50 3C, but the temperature therefor may be lower than 18 3C or higher than 50° C. depending on cases.

A color developing solution used in the development process of the photographic material according to the invention preferably is an alkaline aqueous solution mainly containing a aromatic primary amine-color developing agent. As the color developing agents, aminophenol compounds and p-phenylenediamine compounds are preferably employed. Concrete examples of the p phenylenediamine compounds include 3-methyl-4-amino-N,N-diethylaniline, 3-methyl-4-amino-N ethyl-N-β-hydroxyethylaniline, 3-methyl4-amino-N-ethyl-N-β-methanesulfonamidethylaniline, 3-methyl 4-amino-N-ethyl-N-β-methoxyethylaniline; and sulfates, chlorides and p-toluenesulfonates of those compounds. Generally, salts of diamines are more preferably employed than free diamines, because they show higher stability than free diamines.

The color developing solution generally contains pH buffering agents (e.g., carbonates of alkali metals, borates thereof and phosphates thereof), development inhibitors (e.g., bromides, iodides, benzimidazoles, benzothiazoles and mercapto compounds) or anti-fogging agents. If necessary, the color developing solution may further contain other additives such as preservatives (e.g., hydroxylamine and sulfite), organic solvents (e.g., triethanol amine and diethylene glycol), development accelerators (e.g., benzyl alcohol, polyethylene glycol, quarternary ammonium salts and amines), nucleus-forming agents (e.g., color-forming couplers, completing couplers and sodiumboron hydrides), development-assisting agents (e.g., l-phenyl-3-pyrazolidone), viscosity-increasing agents, chelating agents (e.g., aminopolycarboxylic acid, aminopolyphosphonic acid, alkylphosphonic acid and phosphonocarboxylic acid), and antioxidants described in West German Patent Application (OLS) No. 2,622,950.

In the development process of color reversal photographic materials, color development is generally made after monochromatic development. A monochromic developing solution used in the monochromatic development generally contains various monochromatic developing agents such as dihydroxybenzenes (e.g., hydroquinone), 3-pyrazolidones (e.g., l-phenyl-3-pyrazolidone), and aminophenols (e.g., N-methyl-p-aminophenol). Those monochromatic developing agents can be employed singly or in combination. The photographic emulsion layer is generally subjected to bleaching process after the color development process. The bleaching process may be done simultaneously with a fixing process or separately from the fixing process For the rapid processing, a bleach-fix process can be made after the bleaching process. As the bleaching agents, there can be used polyvalent metal compounds such as iron(III), cobalt(III), chromium(IV) and copper(II), peracids, quinones, and nitroso compounds. Representative examples of the bleaching agents include ferricyanides; dichromates; organic complex salts of iron(III) or cobalt(III) such as complex salts of aminopolycarboxylic acids (e.g., ethylenediaminetetraacetic acid, diethylene-triaminepentaacetic acid, nitrilotriacetic acid and 1,3-diamino-2-propanoltetraacetic acid) and complex salts of citric acid, tartaric acid and malic acid; persulfates; manganates; and nitrosophenol. Among them, ethylenediaminetetraacetic acid iron(III) salt, diethylenetriamine pentaacetic acid iron(III) salt and persulfate are preferred from the viewpoints of rapid processing and prevention of environmental pollution. Also preferred is ethylenediaminetetraacetic acid iron(III) complex salt in each of an individual bleaching solution (bleaching bath) and in a bleach-fix bath.

A bleaching accelerator can be optionally used in the bleaching bath, the bleach-fix bath or the prior bath to those baths.

Examples of the effective bleaching accelerators are as follows.

Compounds having mercapto group or disulfide group as described in U.S. Pat. No. 3,893,858, West German Patents No. 1,290,812 and No. 2,059,988, Japaneses Patent Provisional Publications No. 53(1978).32736, No. 53(1978) 57831, No. 53(1978) 37418, No. 53(1978).65732, No. 53(1978).72623, No. 53(1978).95630, No. 53(1978).95631, No. 53(1978) 104232, No. 53(1978) 124424, No. 53(1978).141623 and No. (1978) 28426, and "Research Disclosure", No. 17129 (July, Thiazolidine derivatives as described in Japanese Patent Provisional Publication No. 50(1975) 140129; Thiourea derivatives as described in Japanese Patent Publication No. 45(1970) 8506, Japanese Patent Provisional Publications No. 52(1977) 20832 and No. 53(1978) 32735, and U.S. Pat. No. 3,706,561;

Iodides as described in West German Patent No. 1,127,715 and Japanese Patent Provisional Publication No. (1983) 16235;

Polyethylene oxides as described in West German Patents No. 966,410 and No. 2,748,430;

Polyamine compounds as described in Japanese Patent Publication No. 45(1970)-8836;

and

Compounds as described in Japanese patent Provisional Publications No. 49(1974).42434, No. 49(1974) 59644, No. (1978) 94927, No. 54(1979)35727, No. 55(1980) 26506 and No. 58(1983) 163940.

In addition to the above-mentioned compounds, iodine ion and bromine ion can be also employed as the bleaching accelerator.

As the bleaching accelerator, preferred are compounds having mercapto group or disulfide group because these compounds show high acceleration effects, and particularly preferred are compounds described in U.S. Pat. No. 3,893,858, west German Patent No. 1,290,812 and Japanese Patent Provisional Publication No. 53(1978)-95630. Also preferred are compounds described in U.S. Pat. No. 4,552,834.

The above-mentioned bleaching accelerators may be contained in the photographic material. Employment of the bleaching accelerators is particularly effective in the bleach-fix process of color photographic materials for picture-taking.

Examples of fixing agents include thiosulfates, thiocyanates, thioether compound, thioureas, and iodides. Of these, thiosulfates are generally used. As the bleach-fix bath or the preservative, sulfites, bisulfites and carbonylbisulfurous acid addition products are preferably employed.

After the bleach-fix process or the fixing process, the photographic light-sensitive material is generally subjected to washing with water and stabilization. In the washing stage or the stabilization stage, a variety of known compounds can be used for the purpose of preventing precipitation, saving water, etc. For example, there can be used hard water-softening agents for preventing the precipitation, such as inorganic phosphoric acids, aminopolycarboxylic acids, organic aminopolyphosphoric acids and organic phosphoric acids; germicides, mildewcides and metal salts (e.g magnesium salts, aluminium salts and bismuth salts) for preventing various bacteria, alga and mildew; surface active agents for preventing drying strain or drying mark; and various hardeners for film-hardening. Otherwise, compounds described in L. E. West, "Photographic Science And Engineering", vol. 6, pp 344–359, (1955) can be also employed. Particularly preferred are chelating agents and mildewcides.

In the washing process, countercurrent washing using two or more baths is generally employed to save water. Instead of the washing process, multi-stage countercurrent stabilizing process can be used, and in this case, 2–9 countercurrent baths are required. To the stabilizing baths are added various compounds to stabilize resulting images in addition to the above-mentioned additives. Examples of the compounds include various buffering agents for adjusting pH value of the resulting films (for example, adjusting to pH of 3–9), and aldehydes (e.g., formalin). Examples of the buffering agents include borates, methaborates, sodium tetraborate decahydrates, phosphates, carbonates, potassium hydroxide, sodium hydroxide, ammonia water, monocarboxylic acids, dicarboxylic acids and polycarboxylic acids, in appropriate combination. Further, if desired, other additives such as chelating agents (e.g., inorganic phosphoric acids, aminopolycarboxylic acids, organic phosphoric acids, organic phosphonic acids, aminopolyphosphonic acids and phosphonocarboxylic acids), germicides (e.g., benzoisothiazolinone, irithiazorone, 4-thiazolinebenzimidazole, halogenated phenol, sulfanylamide and benzotriazole), surface active agents, brightening agents and hardeners can be also employed. Those additives can be used in combination of two or more same kinds or different kinds.

As the pH-adjusting agents employable after the washing and stabilization processes, there can be preferably mentioned various ammonium salts such as ammonium chloride, ammonium nitrate, ammonium sulfate, ammonium phosphate, ammonium sulfite and ammonium thiosulfate.

In the use of the color photographic material for picture-taking, washing and stabilization process of one stage generally made after fixing process can be replaced with the aforementioned stabilization process and the washing process (water-saving stage) In this case, formalin used in the stabilizing bath can be omitted when the used magenta coupler has two equivalent weight.

The time required for the washing and stabilizing process depends on the kind of the photographic material or the treating conditions, but generally is in the range of 20 seconds to 10 minutes, preferably in the range of 20 seconds to 5 minutes.

The silver halide color photographic material can contain a color developing agent for the purpose of simple processing and rapid processing. For incorporation of the color developing agent, various precursors releasing the color developing agents can be preferably employed. Examples of the precursors employable for the purpose include indolenine compounds as described in U.S. Pat. No. 3,342,597; Shchiff's base type compounds as described in U.S. Pat. No. 3.342.599 and "Research Disclosure", Nos. 14,850 and 15159; aldol compounds as described in "Research Disclosure", No. 13,924; metal complex salts as described in U.S. Pat. No. 3,719,492; urethane compounds as described in Japanese Patent Provisional Publication No. 3(1978) 135628; and other salt type precursors as described in Japanese Patent Provisional Publications No. 56(1981)-6235, No. 56(1981)-16133, No. 56(1981)-59232, No. 56(1981)-67842, No. 56(1981)-83734, No. 56(1981)-83735, No. 56(1981)-83736, No. 56(1981)-89735, No. 56(1981)-81837, No. 56(1981)-54430, No. 56(1981)-106241, No. 54(1979)-107236, No. 57(1982)-97531 and No. 57(1082)-83565.

Into the silver halide color photographic material may be incorporated l-phenyl-3-pyrazolidones to accelerate color development. Typical compounds used for the purpose are described for example in Japanese Patent Provisional Publications No. 56(1981)-64339, No. 57(1982) 144547, No. 7(1982) 211147, No. 58(1983)-50532, No. 58(1983) 50533, No. 58(1983) 50534, No. 58(1983)-50535, No. 58(1983) 50536 and No. 58(1083) 115438.

The various baths (solutions) used in the above-mentioned processes generally can have a temperature ranging from 10 to 50 3C. The temperature thereof generally is in the range of 33 to 38 3C, but it can be made higher to accelerate the processing so as to shorten the processing time. Otherwise, it can be made lower to improve qualities of the resulting images or to enhance the stability of the baths. Further, cobalt intensification described in West German Patent No. 2,226,770 or hydrogen peroxide intensification described in U.S. Pat. No. 3,674,499 can be made to save the silver of the photographic material.

The above-mentioned various baths may be equipped with a heater, a temperature sensor, a liquid level sensor, a circulating pump, a filter, a floating lid, a squeegee, etc., if desired.

In the continuous processing, a replenisher for each bath can be used to prevent the bath composition from varying, whereby a uniform finish can be obtained. The replenisher can be used in an amount of half of the standard amount or smaller amount than half of the standard amount to reduce the cost.

When the photographic material of the invention is used as a color paper, the above-mentioned bleach-fix process is generally made, and when the photographic material of the invention is used as a color photographic material for picture-taking, the same process is made according to the necessity.

The examples of the invention and the comparison examples are given below.

EXAMPLE 1

The following coating composition was coated over a cellulose acetate film (support) in an amount of 50 ml/m$^2$, and the coated layer of the composition was dried at 80° C. for 5 minutes to form a surface layer on the support. Thus, a sample (A) was prepared.

| Coating composition | |
|---|---|
| Ester obtained from behenic acid and isostearyl alcohol (Compound (I-1)) | 0.3 g |
| Methylene chloride | 30 ml |
| Acetone | 270 ml |
| Diacetyl cellulose | 1 g |

The compound (I.1) in the above composition has the following chemical formula:

$$(n)C_{21}H_{43}COOC_{18}H_{37}(iso)$$

EXAMPLES 2-5

The procedure of Example 1 was repeated except for using each of the following compounds (I-3), (I-4), (I-5) and (I-11) instead of the compound (I-1) in the coating composition, to prepare samples (B), (C), (D) and (E), each corresponding to the compounds (I-3), (I-4), (I-5) and (I 11), respectively.

Compound (I-3): $(iso)C_{17}H_{35}COOC_{32}H_{65} - C_{36}H_{73}(iso)$
Compound (I-4): $(n)C_{27}H_{55}COOC_{18}H_{37}(iso)$
Compound (I-5): $(n)C_{17}H_{35}COOC_{32}H_{65} - C_{36}H_{73}(iso)$
Compound (I-11): $(n)C_{27}H_{55}COOC_{24}H_{49}(iso)$

COMPARISON EXAMPLES 1

The procedure of Example 1 was repeated except for using the following compound (behenyl behenate) instead of the compound (I-1) in the coating composition, to prepare a sample (W) for comparison.

Behenyl behenate: $(n)C_{21}H_{43}COOC_{22}H_{45}(n)$

COMPARISON EXAMPLES 2

The procedure of Comparison Example 1 was repeated except for not using the behenyl behenate, to prepare a sample (X) for comparison.

EVALUATION OF PHOTOGRAPHIC LIGHT-SENSITIVE MATERIAL

The samples (A) to (E) obtained in Examples 1 to 5 and the samples (W) and (X) obtained in Comparison Examples 1 and 2 were evaluated on the dynamic friction coefficient of the surface layer and the resistance to damage thereof according to the following tests.

RESISTANCE TO DAMAGE

The dynamic friction coefficient of the surface layer was measured under the conditions of a load of 10 g and a speed of 20 cm/min using a copper ball having a diameter of mm (available from Toyo Baldwin Co., Ltd.).

RESISTANCE TO DAMAGE

The resistance to damage of the surface layer was evaluated by scratching the surface layer with a diamond stylus of 0.025 mmR with a continuous load of 0 100 g using Heide-1,8 type measuring machine (produced by Shinto Kagaku Co., Ltd.) and measuring the load (g) when the scratch was observed with a transmitted light.

The above-mentioned tests were carried out immediately after the formation of the surface layer and in 3 months after the formation of the surface layer.

The results are set forth in Table 1.

TABLE 1

| | | Dynamic Friction Coefficient | | Resistance to Damage (g) | |
|---|---|---|---|---|---|
| Sample | Compound | Immediately | After 3 months | Immediately | After 3 months |
| (A) | I-1 | 0.20 | 0.21 | 54 | 55 |
| (B) | I-3 | 0.20 | 0.21 | 59 | 59 |
| (C) | I-4 | 0.20 | 0.20 | 45 | 44 |
| (D) | I-5 | 0.20 | 0.19 | 61 | 60 |
| (E) | I-11 | 0.13 | 0.14 | 59 | 60 |
| (W) | Behenyl behenate | 0.23 | 0.35 | 43 | 30 |
| (X) | — | 0.42 | 0.43 | 17 | 16 |

As is apparent from the results set forth in Table 1, the samples (A) to (E) each having a surface layer containing the compound (I-1), (I-3), (I-4), (I-5) or (I-11) had lowerdynamic friction coefficients and higher resistance to damage as compared with the sample (X) for comparison. Further, any change was not observed in the appearance of each surface layer of the samples (A) to (E) immediately after the formation of the surface layer or even with time. On the other hand, the coating composition used in Comparison Example 1 turned to turbid because of its poor liquid stability, and in 24 hours after the composition was coated, the surface of the coated layer was deposited with white powders. The surface layer of the sample (W) showed high dynamic friction coefficient and lower resistance to damage.

Each of the samples (A) to (E) was coated with a photographic emulsion for fluorography containing 9 wt. % of gelatin and 9 wt. % of silver halide on a surface of the support where the surface layer was not provided, to prepare photographic light-sensitive materials (A) to (E) each corresponding to the samples (A) to (E), respectively. Thus obtained photographic light-sensitive materials were laid one upon another in such a manner that the light-sensitive layer of one material was brought into contact with the back surface of the adjacent material, and they were stored at room temperature for 3 months. Then, the photographic materials were examined on the sensitivity and the tendency of fogging, and as a result, any change was not observed on the photographic materials. Further, any stain caused by bleeding of the ester compounds was not observed on the back surface of each material.

EXAMPLE 6

The following coating composition was coated over a cellulose acetate film (support) in an amount of 50 ml/m$^2$, and the coated layer of the composition was dried at 80° C. for 5 minutes to form a surface layer on the support. Thus, a sample (F) was prepared.

| Coating composition | |
|---|---|
| Diester obtained from succinic acid and iso $C_{24}$ alcohol (Compound (II-1)) | 0.3 g |
| Methylene chloride | 30 ml |
| Acetone | 270 ml |
| Diacetyl cellulose | 1 g |

The compound (II-1) in the above composition has the following chemical formula:

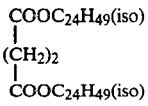

EXAMPLES 7-14

The procedure of Example 6 was repeated except for using each of the following compounds (II-2), (II-5), (II-6), (II-8), (II-9), (II-12), (II-4) and (II-16) instead of the compound (1) in the coating composition, to prepare samples (G) to (N), each corresponding to each compound.

Compound (II-2)
(diester obtained from adipic acid and iso $C_{24}$–$C_{26}$ alcohol)

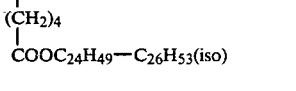

(Compound (II-5)
(diester obtained from sebacic acid and iso $C_{32}$–$C_{36}$ alcohol)

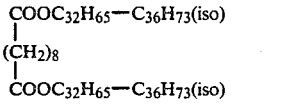

Compound (II-6)
(diester obtained from dodecanedicarboxylic acid and iso $C_{24}$–$C_{26}$ alcohol)

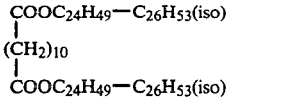

Compound (II-8)
(diester obtained from eicosanedicarboxylic acid and iso $C_{24}$–$C_{26}$ alcohol)

-continued

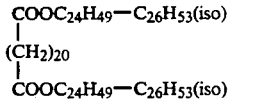

Compound (II-9)
(diester obtained from $C_{20}$ ethyl branched dicarboxylic acid and iso $C_{24}$-$C_{26}$ alcohol)

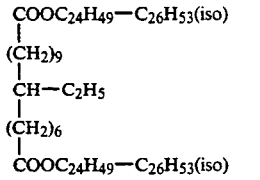

Compound (II-12)
(diester obtained from $C_{22}$ methyl branched dicarboxylic acid and iso $C_{24}$-$C_{26}$ alcohol)

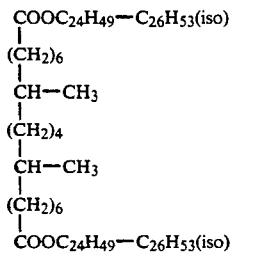

Compound (II-4)
(diester obtained from sebacic acid and iso $C_{24}$-$C_{26}$ alcohol)

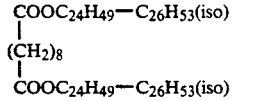

Compound (II-16)
(diester obtained from hydrogenated dimer acid and iso $C_{32}$-$C_{36}$ alcohol)

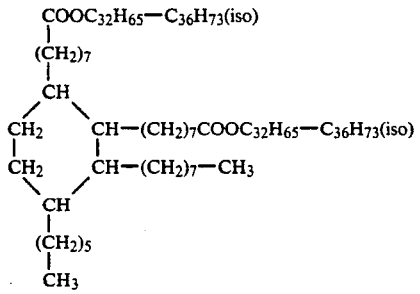

COMPARISON EXAMPLE 3

The procedure of Example 6 was repeated except for using the following compound (diester obtained from succinic acid and behenyl alcohol) instead of the compound (II-1) in the coating composition, to prepare a sample (Y) for comparison.

Diester obtained from succinic acid and behenyl alcohol

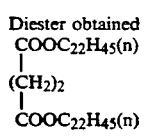

COMPARISON EXAMPLE 4

The procedure of Comparison Example 3 was repeated except for not using the diester obtained from succinic acid and behenyl alcohol, to prepare a sample (Z) for comparison.

EVALUATION OF PHOTOGRAPHIC LIGHT-SENSITIVE MATERIAL

The samples (F) to (N) obtained in Examples 6 to 14 and the samples (Y) and (Z) obtained in Comparison Examples and 4 were evaluated on the dynamic friction coefficient of the surface layer and the resistance to damage thereof according to the above-mentioned tests.

The results are set forth in Table 2.

TABLE 2

| Sample | Compound | Dynamic Friction Coefficient | | Resistance to Damage (g) | |
|---|---|---|---|---|---|
| | | Immediately | After 3 months | Immediately | After 3 months |
| (F) | II-1 | 0.29 | 0.28 | 45 | 44 |
| (G) | II-2 | 0.26 | 0.26 | 44 | 45 |
| (H) | II-5 | 0.13 | 0.14 | 65 | 63 |
| (I) | II-6 | 0.20 | 0.19 | 54 | 55 |
| (J) | II-8 | 0.20 | 0.20 | 57 | 55 |
| (K) | II-9 | 0.29 | 0.28 | 56 | 58 |
| (L) | II-12 | 0.24 | 0.25 | 46 | 45 |
| (M) | II-4 | 0.27 | 0.26 | 45 | 49 |
| (N) | II-16 | 0.17 | 0.17 | 57 | 57 |
| (Y) | Diester of succinic acid and behenyl alcohol | — | — | — | — |
| (Z) | — | 0.42 | 0.43 | 17 | 17 |

As is apparent from the results set forth in Table 2, the samples (F) to (N) each having a surface layer containing the compound (II-1), (II-2), (II-5), (II-6), (II-8), (II-9), (II-12), (II-4) or (II-16) had lower dynamic friction coefficints and higher resistance to damage as compared with the sample (Z) for comparison which is not contain a lubricant (i.e., slip property-increasing agent). Further, any change was not observed in the appearance of each surface layer of the samples (F) to (N) immediately after the formation of the surface layer or even with time. On the other hand, the coating composition used in Comparison Example 3 turned to turbid because of its poor liquid stability, and the coated layer of the composition showed uneven surface, so that the dynamic friction coefficient and the resistance to damage of the surface layer were immeasurable.

Each of the samples (F) to (N) was coated with a photographic emulsion for fluorography containing 9 wt. % of gelatin and 9 wt. % of silver halide on a surface of the support where the surface layer was not provided, to prepare photographic light-sensitive materials (F) to (N) each corresponding to the samples (F) to (N), respectively. Thus obtained photographic light-sensitive materials were laid one upon another in such a manner that the light-sensitive layer of one material was brought into contact with the back surface of the adjacent material, and they were stored at room temperature for 3 months. Then, the photographic materials were examined on the sensitivity and the tendency of fogging, and as a result, any change was not observed on the photographic materials. Further, any stain caused by bleeding of the ester compounds was not observed on the back surface of each material.

We claim:

1. A silver halide photographic light-sensitive material comprising a support and a light-sensitive silver halide emulsion layer provided on the support, wherein a surface layer provided on the photographic light-sensitive material contains an aliphatic carboxylic ester having the formula (I):

$$R^{11}COOR^{12} \quad (I)$$

in which each of $R^{11}$ and $R^{12}$ independently is analiphatic hydrocarbon group having 12–70 carbon atoms; said $R^{12}$ having a branch at the second position from the carbon atom bonded to the ester group; and the number of the total carbon atoms contained in $R^{11}$ and $R^{12}$ is in the range of 32 to 140.

2. The silver halide photographic light-sensitive material as claimed in claim 1, wherein the branched aliphatic hydrocarbon group in the formula (I) has 24 or more carbon atoms.

3. The silver halide photographic light-sensitive material as claimed in claim 1, wherein the number of the total carbon atoms contained in $R^{11}$ and $R^{12}$ in the formula (I) is in the range of 41 to 140.

4. The silver halide photographic light-sensitive material as claimed in claim 1, wherein each of $R^{11}$ and $R^{12}$ in the formula (I) independently is a branched aliphatic hydrocarbon group having 12 or more carbon atoms.

5. The silver halide photographic light-sensitive material as claimed in claim 1, wherein each of $R^{11}$ and $R^{12}$ in the formula (I) independently is a branched aliphatic hydrocarbon group having 24 or more carbon atoms.

6. The silver halide photographic light-sensitive material as claimed in claim 1, wherein the silver halide emulsion layer is provided on one side of the support and the surface layer is provided as a backing layer on the other side of the support where the silver halide emulsion layer is not provided.

7. The silver halide photographic light-sensitive material as claimed in claim 1, wherein the aliphatic carboxylic ester having the formula (I) is contained in the surface layer in an amount of 0.02 to 300% by weight based on the total solid content of the surface layer.

8. The silver halide photographic light-sensitive material as claimed in claim 1, wherein the aliphatic carboxylic ester having the formula (I) is contained in the surface layer in an amount of 0.1 to 150% by weight based on the total solid content of the surface layer.

9. The silver halide photographic light-sensitive material as claimed in claim 1, wherein the support is a flexible support consisting of a semi synthetic or synthetic polymer.

10. A silver halide photographic light-sensitive material comprising a support and a light-sensitive silver halide emulsion layer provided on the support, wherein a surface layer provided on the photographic light-sensitive material contains an aliphatic carboxylic ester having the formula (II):

$$R^{21}OOCXCOOR^{22} \quad (II)$$

in which each of $R^{21}$ and $R^{22}$ independently is an aliphatic hydrocarbon group having 12–70 carbon atoms; X is a divalent linking group selected from the group consisting of a branched hydrocarbon, $$-(CH_2)_n- \quad (n = 2\text{–}20) \qquad -CH_2CH_2OCH_2CH_2-$$

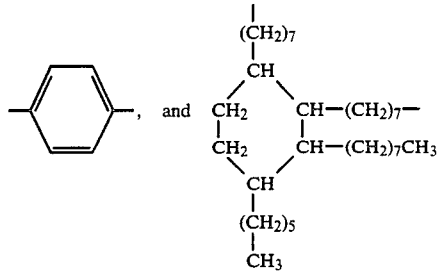

at least one of $R^{21}$, $R^{22}$ and X is a branched aliphatic hydrocarbon group having 12 or more carbon atoms; and the number of the total carbon atoms contained in $R^{21}$ and $R^{22}$ is in the range of 32 to 140.

11. The silver halide photographic light-sensitive material as claimed in claim 10, wherein the number of the total carbon atoms contained in $R^{21}$ and $R^{22}$ in the formula (II) is in the range of 40 to 140.

12. The silver halide photographic light-sensitive material as claimed in claim 10, wherein the branched aliphatic hydrocarbon group represented by $R^{21}$, $R^{22}$ or X in the formula (II) has 24 or more carbon atoms.

13. The silver halide photographic light-sensitive material as claimed in claim 10, wherein each of $R^{21}$ and $R^{22}$ in the formula (II) independently is a branched aliphatic hydrocarbon group having 12 or more carbon atoms.

14. The silver halide photographic light-sensitive material as claimed in claim 10, wherein each of $R^{21}$ and $R^{22}$ in the formula (II) independently is a branched aliphatic hyrocarbon group having 24 or more carbon atoms.

15. The silver halide photographic light-sensitive material as claimed in claim 10, wherein the silver halide emulsion layer is provided on one side of the support and the surface layer is provided as a backing layer on the other side of the support where the silver halide emulsion layer is not provided.

16. The silver halide photographic light-sensitive material as claimed in claim 10, wherein the aliphatic carboxylic ester having the formula (II) is contained in the surface layer in an amount of 0.02 to 300% by weight based on the total solid content of the surface layer.

17. The silver halide photographic light-sensitive material as claimed in claim 10, wherein the aliphatic carboxylic ester having the formula (II) is contained in the surface layer in an amount of 0.1 to 150% by weight based on the solid weight of the surface layer.

18. The silver halide photographic light-sensitive material as claimed in claim 10, wherein the support is a flexible support consisting of a semi-synthetic or synthetic polymer.

* * * * *

UNITED STATES PATENT AND TRADEMARK OFFICE

CERTIFICATE OF CORRECTION

PATENT NO. : 5,063,147

DATED : November 5, 1991

INVENTOR(S) : Yoneyama et al

It is certified that error appears in the above-identified patent and that said Letters Patent is hereby corrected as shown below:

On the cover page, delete item [73] and insert therefore the following:

-- [73] Assignees: Fuji Photo Film Co., Ltd., Kanagawa
Nisshin Oil Mills, Ltd., Tokyo, both of
Japan --

Signed and Sealed this

First Day of December, 1992

*Attest:*

DOUGLAS B. COMER

*Attesting Officer*

*Acting Commissioner of Patents and Trademarks*